US011518635B2

(12) United States Patent
Asada et al.

(10) Patent No.: US 11,518,635 B2
(45) Date of Patent: Dec. 6, 2022

(54) TRANSPORT DEVICE INCLUDING A COVER HAVING A FRAME ENGAGEMENT FEATURE

(71) Applicant: BROTHER KOGYO KABUSHIKI KAISHA, Nagoya (JP)

(72) Inventors: Tetsuo Asada, Kuwana (JP); Asami Hashimoto, Okazaki (JP); Gakuro Kanazawa, Toyokawa (JP); Yoichiro Nishimura, Kitakyusyu (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 315 days.

(21) Appl. No.: 16/820,811

(22) Filed: Mar. 17, 2020

(65) Prior Publication Data

US 2020/0299085 A1 Sep. 24, 2020

(30) Foreign Application Priority Data

Mar. 22, 2019 (JP) ..... JP2019-054152
Mar. 13, 2020 (JP) ..... JP2020-043870

(51) Int. Cl.
*B65H 5/36* (2006.01)
*B65H 5/06* (2006.01)
*B41J 29/02* (2006.01)

(52) U.S. Cl.
CPC ..... *B65H 5/36* (2013.01); *B41J 29/02* (2013.01); *B65H 5/06* (2013.01); *B65H 2402/443* (2013.01); *B65H 2801/03* (2013.01)

(58) Field of Classification Search
CPC ... B65H 5/36; B65H 2402/31; B65H 2402/32
See application file for complete search history.

(56) References Cited

U.S. PATENT DOCUMENTS 8,521,063 B2 * 8/2013 Saito ..... G03G 21/1633 399/121
8,737,879 B2 * 5/2014 Ito ..... G03G 21/1633 399/124
8,967,620 B2 * 3/2015 Ishikura ..... G03G 21/16 399/121
9,914,607 B2 * 3/2018 Yamaguchi ..... B65H 5/36
(Continued)

FOREIGN PATENT DOCUMENTS

JP 2009-179447 A 8/2009
JP 2013-166623 A 8/2013

*Primary Examiner* — Howard J Sanders
(74) *Attorney, Agent, or Firm* — Merchant & Gould P.C.

(57) ABSTRACT

In a transport device, a cover defining a portion of a transport path is pivotable between a closed state and an open state. The cover is movable while in the closed state between a first position and a second position lower than the first position. An urging member urges the cover from the second position toward the first position. The cover includes a main body for guiding the sheet in the transport direction and an engagement portion engaged with a frame when the cover is at the first position to restrict pivoting of the cover from the first position to a third position at which the cover is in the open state. The engagement portion is disengaged from the frame when the cover is at the second position to allow pivoting of the cover from the second position to the third position.

18 Claims, 10 Drawing Sheets

(56) References Cited

U.S. PATENT DOCUMENTS

| | | | | |
|---|---|---|---|---|
| 2006/0093397 | A1* | 5/2006 | Yamaoka | G03G 21/1633 399/110 |
| 2009/0194931 | A1 | 8/2009 | Shiohara et al. | |
| 2010/0278557 | A1* | 11/2010 | Somemiya | G03G 21/1638 399/124 |

* cited by examiner

TRANSPORT DEVICE INCLUDING A COVER HAVING A FRAME ENGAGEMENT FEATURE

CROSS-REFERENCE TO RELATED APPLICATION

This application claims priority from Japanese Patent Application No. 2019-054152 filed on Mar. 22, 2019, and from Japanese Patent Application No. 2020-043870 filed Mar. 13, 2020, the contents of both of which are incorporated herein by reference in their entirety.

TECHNICAL FIELD

Aspects of the disclosure relate to a transport device for use in an image recording apparatus such as an inkjet printer.

BACKGROUND

A known inkjet printer includes a rear cover defining a portion of a transport path along which a sheet fed by a feed roller is transported. The rear cover is movable between a closed position to partially define the transport path and an open position to expose the transport path, thereby allowing a user to access and remove a jammed sheet.

The rear cover partially defining the transport path receives a force from a sheet transported along the transport path. The force urges the rear cover from the closed position to the open position. Thus, the rear cover is required to securely held at the closed position so as not to move to the open position. On the other hand, in order to remove a jammed sheet, the rear cover is usually moved by a user manually from the closed position to the open position. Thus, the rear cover is required to be easy to operate and movable, without excessive force, from the closed position to the open position.

SUMMARY

Aspects of the disclosure provide a transport device including a cover, e.g., a rear cover, which is securely held at a closed position without the use of an exclusive lock member and which is, at the same time, easy to operate to open and close.

According to one or more aspects of the disclosure, a transport device includes a frame, a holder configured to hold one or more sheets, a feed roller configured to feed a sheet from the holder in a transport direction along a transport path, a cover defining a portion of the transport path, and an urging member. The cover is pivotable between a closed state and an open state. The cover is movable while in the closed state between a first position and a second position lower than the first position. The urging member urges the cover in an urging direction from the second position toward the first position. The cover includes a main body and an engagement portion disposed at the main body. The main body is configured to define the portion of the transport path and guide the sheet in the transport direction. The engagement portion is engaged with the frame when the cover is at the first position to restrict pivoting of the cover from the first position to a third position at which the cover is in the open state. The engagement portion is disengaged from the frame when the cover is at the second position to allow pivoting of the cover from the second position to the third position.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

A transport device according to an illustrative embodiment of the disclosure will now be described with reference to the drawings. The transport device is applied to an image recording apparatus such as an inkjet printer. While the disclosure will be described with reference to a specific embodiment, this is merely an example, and various additions, deletions and changes may be made therein, without departing from the spirit and scope of the disclosure.

An inkjet printer will be described as an example of an image recording apparatus. The image recording apparatus, however, may be a laser printer, a thermal printer, or other printers.

Figure 1:
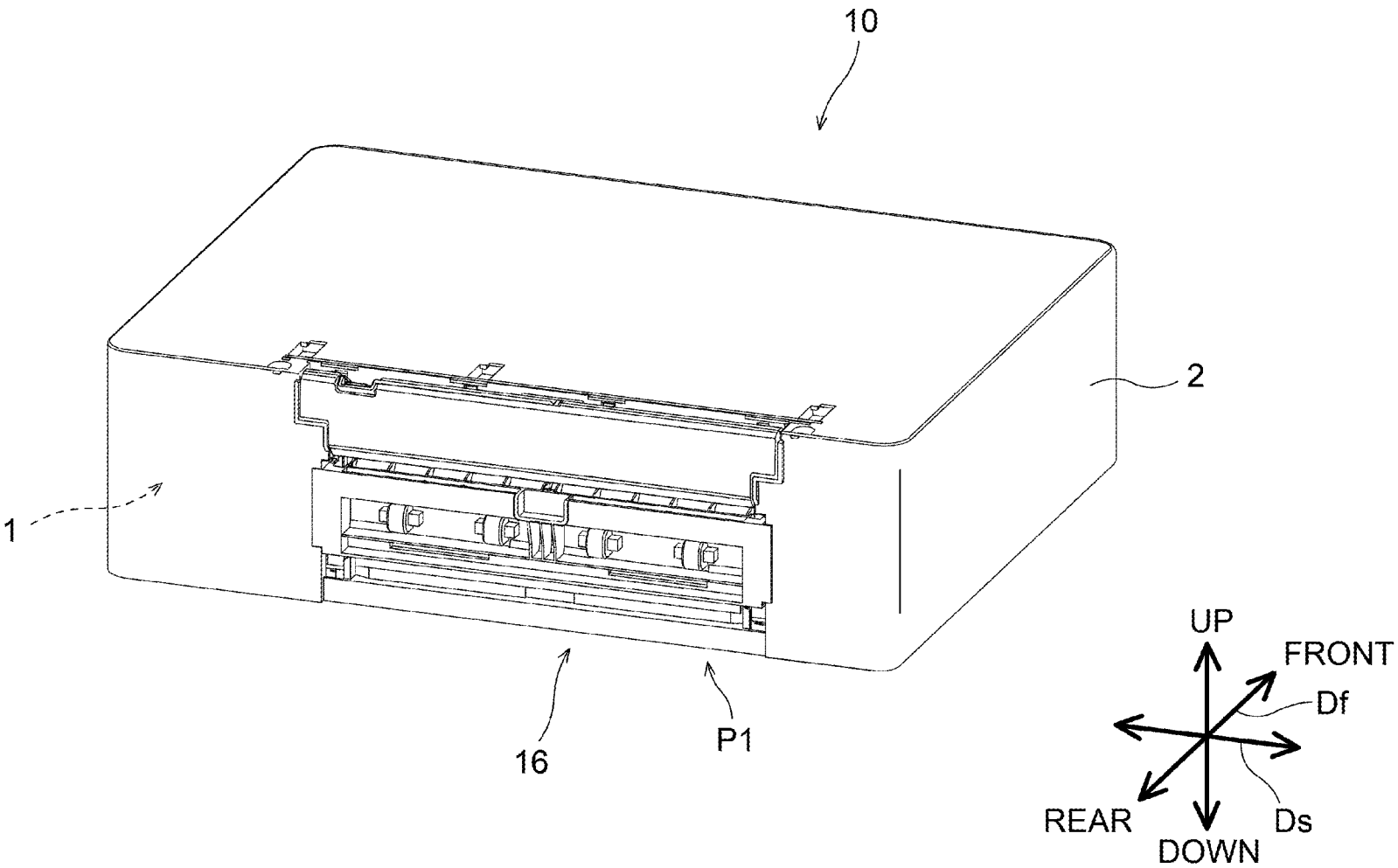
FIG. 1 is a perspective view of an image recording apparatus employing a transport device, according to an illustrative embodiment of the disclosure.

As shown in FIG. 1, an image recording apparatus 10 employing a transport device 1 according to an illustrative embodiment includes a housing 2 which may be rectangular parallelepiped. Some elements of the transport device 1 and a print unit are disposed inside the housing 2 while other elements of the transport device 1 are exposed outside the housing 2. A scanner may be provided on the housing 2.

Figure 2:
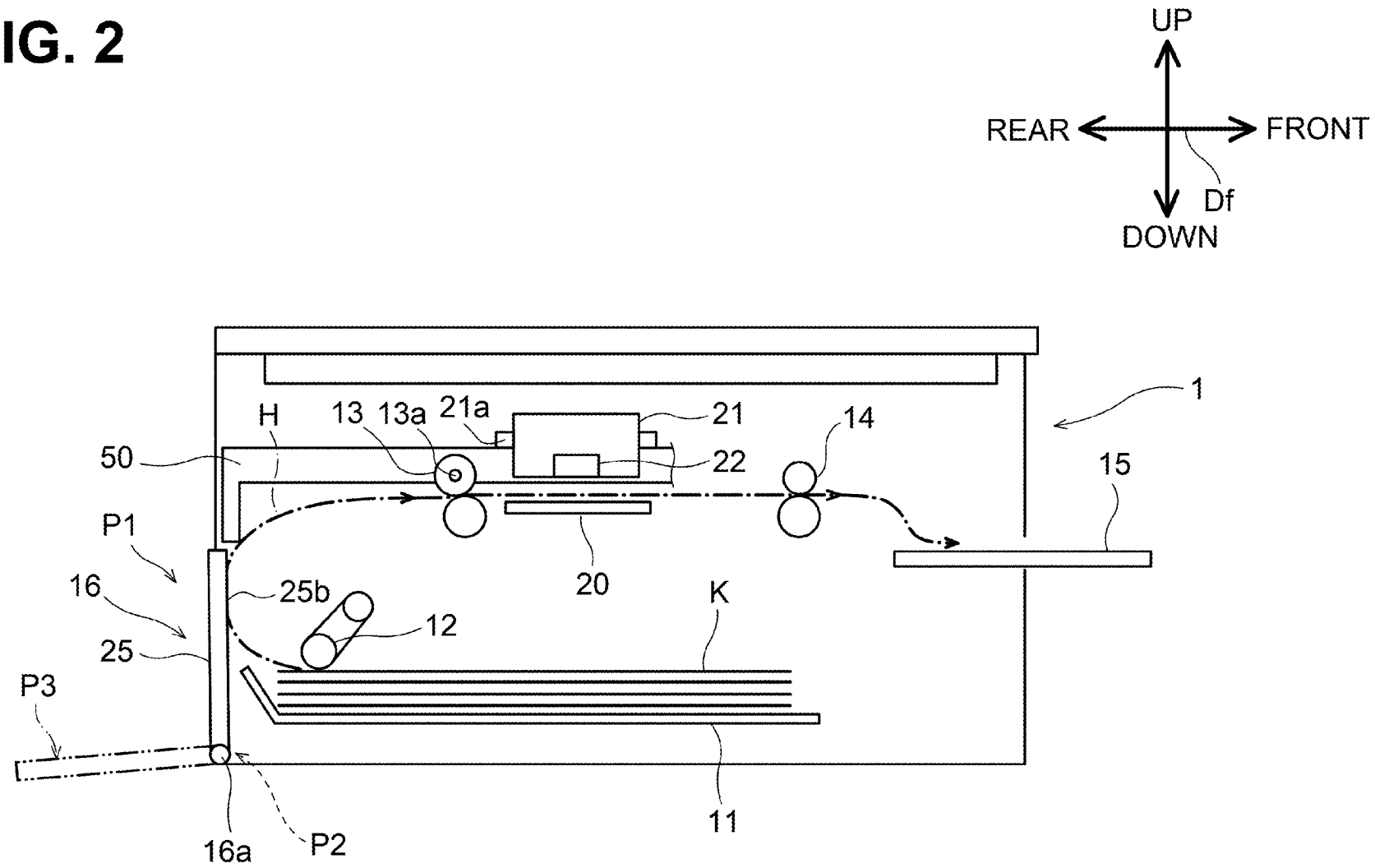
FIG. 2 is a schematic view showing the structure of the transport device of the image recording apparatus of FIG. 1.

As shown in FIG. 2, the transport device 1 in this embodiment includes a holder 11, e.g., a feed tray, for holding sheets K as recording media, a feed roller 12, a transport roller 13 having a drive shaft 13*a*, a discharge roller 14, a discharge tray 15, and a pivot member 16 which is also referred to as a cover, such as a rear cover or a shoot cover. A transport path H is defined to extend from the holder 11 to the discharge tray 15.

The transport roller 13 is disposed downstream of the pivot member 16 in a transport direction. The holder 11 is disposed at a lower portion inside the housing 2. The feed roller 12 feeds a sheet K held in the holder 11, via an inner surface of the pivot member 16, toward the transport roller 13. The transport roller 13 transports the sheet K toward a platen 20 (described later) for printing, and then transports the sheet K toward the discharge roller 14. The discharge roller 14 transports the sheet K toward the discharge tray 15.

The platen 20 is disposed below a portion of the transport path H, the portion being between the transport roller 13 and the discharge roller 14. A carriage 21 is disposed above the platen 20 and includes a recording unit, e.g., a printhead 22, configured to eject ink through nozzles. The carriage 21 is supported by a guide frame 21*a* extending in a main scanning direction, e.g., a left-right direction. The guide frame 21*a* and the drive shaft 13*a* of the transport roller 13 are supported by a frame 50. The frame 50 is disposed inside the housing 2 and includes a portion extending in a front-rear direction.

In the transport device 11 thus structured, a sheet K is fed by the feed roller 12, via the inner surface of the pivot member 16, toward the transport roller 13. Then the sheet K is transported by the transport roller 13 to a position below the printhead 22. The printhead 22 prints an image on the sheet K, and the sheet K having the image printed thereon is discharged by the discharge roller 14 onto the discharge tray 15. The sheet K is transported, along the transport path H, from the holder 11 to the discharge tray 15. Transport rollers other than the transport roller 13 may be provided along the transport path H.

The pivot member 16 is disposed at the rear of the housing 2. The pivot member 16 has a substantially plate shape. The pivot member 16 has a pair of pivot shafts 16*a* and is pivotable about the pivot shafts 16*a* between a closed state to cover the transport path H from an exterior of the housing 2 and an open state to expose the transport path H to the exterior of the housing 2. The pivot member 16, when in the closed state, is urged by a pair of urging members 36 (refer to FIG. 4 described later) into a first position P1. In contrast, when a user operates an operative portion 27 (described later) to push down the pivot member 16 against an urging force of the urging members 36, the pivot member 16 is positioned into a second position P2 lower than the first position P1. The pivot member 16 is pivotable about the pivot shafts 16*a* from the second position P2 to a third position P3 where the pivot member 16 is in the open state. The pivot member 16 is disposed to define a portion of the transport path H. Specifically, a sheet K fed by the feed roller 12 is transported in contact with the inner surface of the pivot member 16 at the first position P1 (in the closed state).

Figure 3:
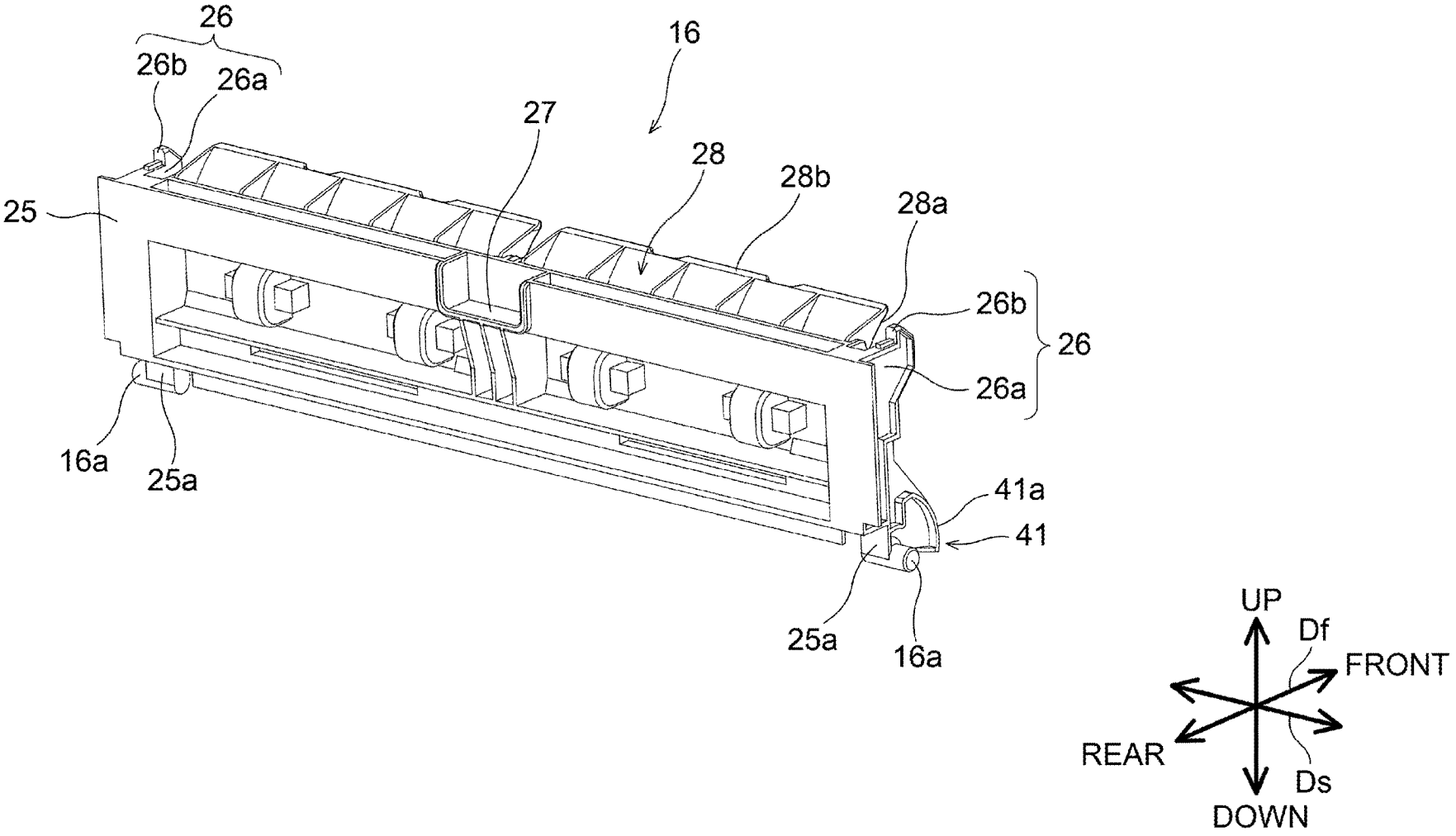
FIG. 3 is a rear perspective view of a pivot member of the transport device of FIG. 1.

As shown in FIG. 3, the pivot member 16 includes a main body 25, a pair of engagement portions 26 disposed at the main body 25, the operative portion 27 disposed at the main body 25, and a guide flap 28 disposed at the main body. In FIG. 3, a main scanning direction is labeled as Ds and a sub-scanning direction orthogonal to the main scanning direction Ds is labeled as Df.

The main body 25 defines a portion of the transport path H (FIG. 2) and has a function to guide a sheet K along the transport path H. Specifically, the main body 25 has a guide surface 25*b* (refer to FIGS. 2 and 5) for guiding a sheet K in a transport direction upwardly in the same direction as the urging direction of the urging members 36 (described later). The main body 25 extends in the main scanning direction Ds and includes a thick portion having a thickness in the sub-scanning direction Df. The main body 25 includes support members 25*a* at lower ends of its opposite ends in the main scanning direction Ds. Each support member 25*a* supports a corresponding pivot shaft 16*a*. Each pivot shaft 16*a* supported by a corresponding support member 25*a* extends leftward or rightward along the main scanning direction Ds.

Figure 4:
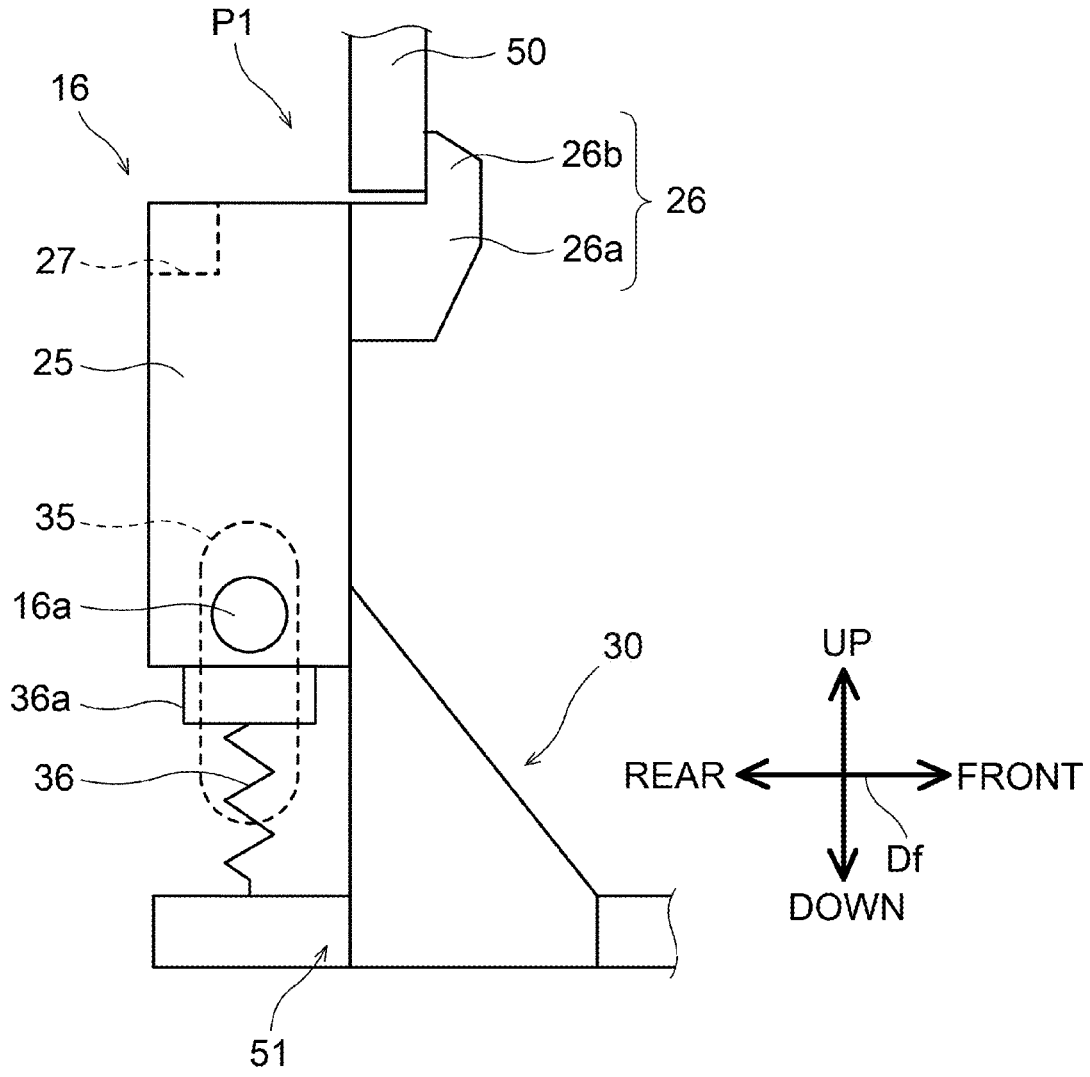
FIG. 4 is a side schematic view of the pivot member of the transport device of FIG. 1.

The man body 25 includes the engagement portions 26 at upper ends of its opposite ends in the main scanning direction Ds. Each engagement portion 26 includes an engagement portion body 26*a* and a claw 26*b* extending upwardly from the engagement portion body 26*a*. As shown in FIG. 4, the claw 26*b* is located at a position above an upper end of the main body 25 when the pivot member 16 is at the first position (in the closed state). As shown in FIG. 4, the claw 26*b* is engaged with the frame 50 (described later) disposed inside the housing 2 when the pivot member 16 is at the first position P1. The pivot member 16 is maintained or locked in the closed state by each claw 26*b* engaged with the frame 50. The claws 26*b* restricts pivoting of the pivot member 16 from the closed state to the open state (third position P3).

The operative portion 27, alternatively referred to herein as a manual contact surface, is a groove formed by cutting out the thick portion of the main body 25. The operative portion 27 has a width (a length in the main scanning direction Ds) which is set to be greater than the maximum width of a finger (e.g., an index finger) of a user. This may allow a user to put his/her finger on the operative portion 27 and push down the main body 25 against an upward urging force of the urging members 36 (described later). The operative portion 27 is disposed at a center of the main body 25 in the main scanning direction Ds, and proximate to a top edge of the main body 25 of the pivot member 16. A pushing force exerted on the operative portion 27 by the user (e.g., manually) is transmitted evenly from the center toward the opposite ends in the main scanning direction Ds. Thus, the main body 25 moves down without tilting. The operative portion 27 thus structured allows the user to move the main body 25 to the second position P2 from which the main body 25 is pivotable toward the third position P3.

Figure 5:
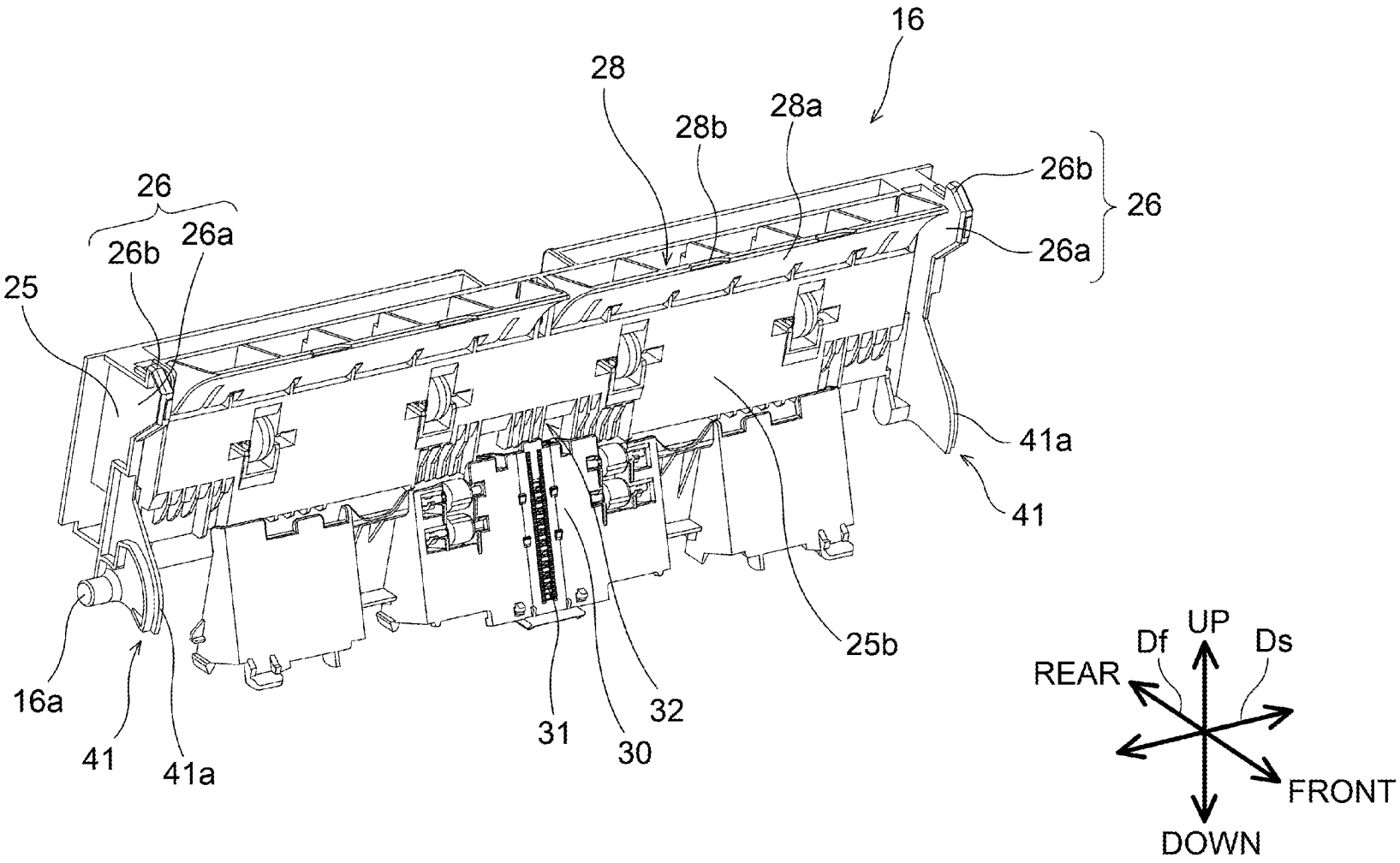
FIG. 5 is a front perspective view of the pivot member of the transport device of FIG. 1.
Figure 6:
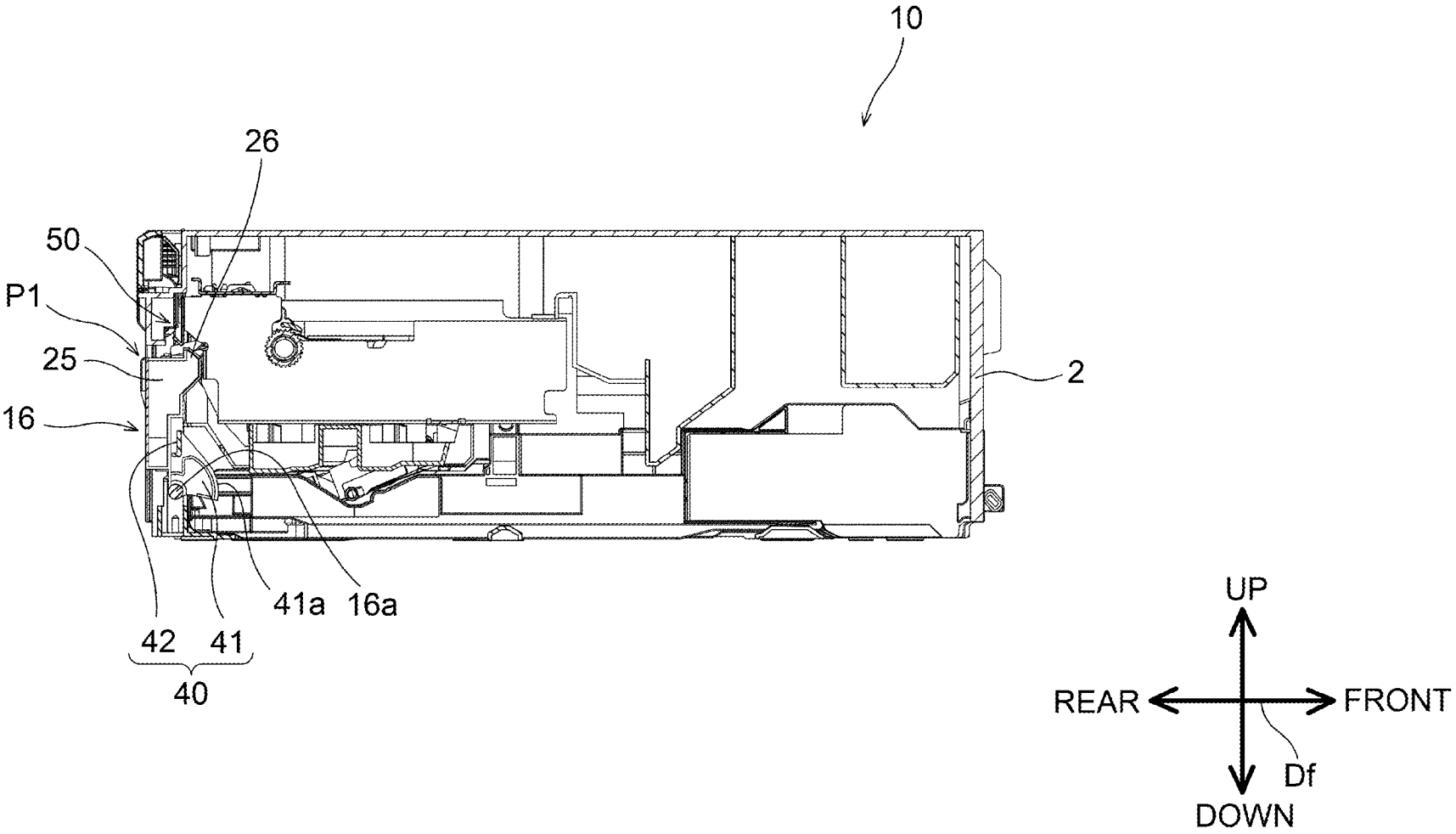
FIG. 6 is a cross-sectional view showing an internal structure of the image recording apparatus when the pivot member shown in FIG. 1 is located at a second position.

As shown in FIG. 5, the guide flap 28 is disposed at an upper portion of the pivot member 16 and defines a portion of the transport path H similarly to the pivot member 16. The guide flap 28 has a curved surface 28*a* which faces the transport roller 13. After a sheet K is guided by the guide surface 25*b* of the main body 25, the sheet K slides in contact with the curved surface 28*a*, thereby being transported toward the transport roller 13. The guide flap 28 has an upper end 28*a* which is substantially level with or above a lower end of the frame 50 when the pivot member 16 is at the second position P2.

As shown in FIG. 5, the image recording apparatus 10 includes a separator 30. The separator 30 is disposed partially below the pivot member 16. The separator 30 is disposed, in the transport direction, between the feed roller 12 and the pivot member 16 located at the first position P1. The separator 30 has an inclined surface extending along the transport direction, and a plurality of protrusions 31 protruding beyond the inclined surface and arrayed in the transport direction. When multiple sheets K are fed to the separator 30, underlining sheets K are caught by the protrusions 31 and separated from an uppermost sheet K. This may prevent feeding of multiple sheets further downstream of the separator 30.

The pivot member 16 has a recess 32 which is recessed so as not to interfere with an upper portion of the separator 30 when the pivot member 16 moves from the first position P1 to the second position P2. This structure may prevent interference between the pivot member 16 and the separator 30 when the pivot member 16 moves to the second position P2.

Referring back to the FIG. 4, the housing 2 of the image recording apparatus 10 includes a pair of guide portions 35 corresponding to the pair of pivot shafts 16*a*. Each guide portion 35, in which a corresponding pivot shaft 16*a* is fitted, guides the corresponding pivot shaft 16*a* to reciprocate up and down such that the pivot member 16 moves between the first position P1 and the second position P2. Each guide portion 35 may be a groove formed in a corresponding one of opposite side walls of the housing 2.

The pair of urging members 36 is disposed at a lower portion of the pivot member 16, corresponding to the pair of the pivot shafts 16*a*. Each urging member 36 may be a spring. An upper end of an urging member 36 is connected to a pushing member 36*a*. A lower end of the urging member 36 is connected to a base 51 disposed inside the housing. The pivot member 16 is usually urged by the urging members 36 from the first position P2 toward the first position P1. This causes the claw 26*a* of each engagement portion 26 to engage a vertical portion of the frame 50. The pivot member 16 is locked at the first position so as not to pivot. The frame 50 positions the pivot member 16 into the first position P1. In contrast, when a user pushes down the operative portion 27, each pivot shaft 16*a* is guided by a corresponding guide portion 35 to move down against an urging force of a corresponding urging member 36, and the main body 25 moves down into the second position P2. Thus, the pivot member 16 moves down from the first position P1 to the second position P2.

Figure 7:
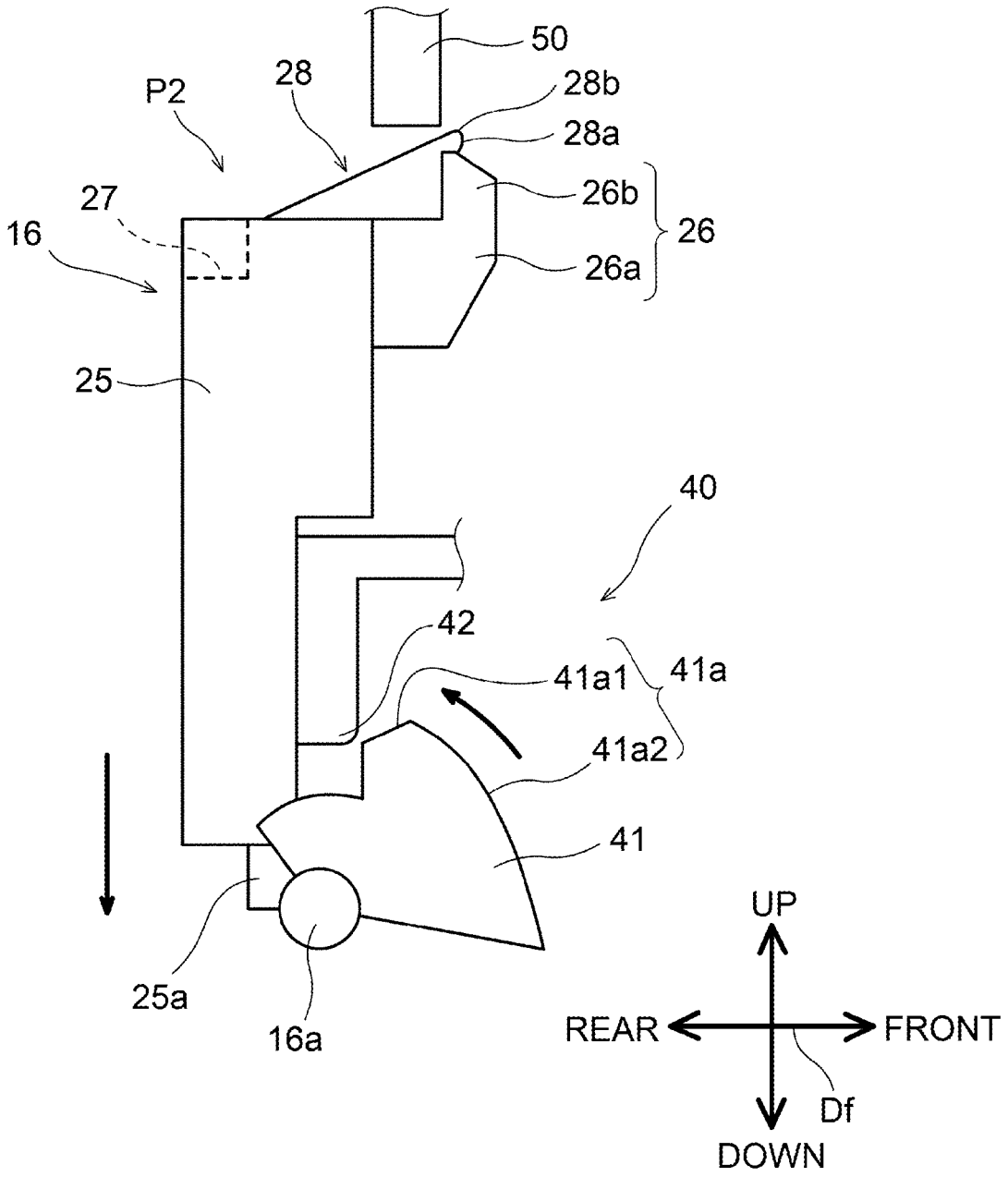
FIG. 7 is a side view showing a detailed structure of a guide mechanism of the transport device of FIG. 1.

As shown in FIG. 7, in response to the pivot member 16 moving from the first position P1 to the second position P2 lower than the first position P1, the claw 26*b* of each engagement portion 26 is released from the frame 50. In other words, the frame 50 no longer restricts pivoting of the pivot member 16 from the second position P2 to the third position P3. Thus, a user is allowed to pivot the pivot member 16 from the second position P2 to the third position P3 into the open state.

As shown in FIG. 7, the transport device 1 includes a guide mechanism 40. In response to the pivot member 16 moving from the second position to the third position, the guide mechanism 40 guides the pivot member 16 to a position lower than the second position P2 against an increasing urging force of each urging member 36 (refer to FIG. 4). The guide mechanism 40 includes a cam 41 and a contact member 42. The cam 41 is connected to a corresponding pivot shaft 16*a* and has a slide surface 41*a*. The slide surface 41*a* includes a flat surface 41*a*1, and a curved surface 41*a*2 continuing from the flat surface 41*a*1. The curved surface 41*a*2 of the cam 41 is a surface arcuate about the pivot shaft 16*a*.

The contact member 42 contacts the slide surface 41*a* of the cam 41 when the pivot member 16 pivots. The contact member 42 is disposed inside the housing 2 and has an L shape in side view. As shown in FIG. 7, a lower end of a vertically extending portion of the contact member 42 is substantially level with a sliding starting end (e.g., rear end) of the flat surface 41*a*1 from which the contact member 42 starts contacting. Before the cam 41 slidably contacts the contact 42, a sliding completion end (e.g., front end) of the flat surface 41*a*1 is located above the sliding starting end (e.g., rear end) of the flat surface 41*a*1. In other words, the flat surface 41*a*1 extends obliquely upward from the rear end to the front end.

Figure 8:
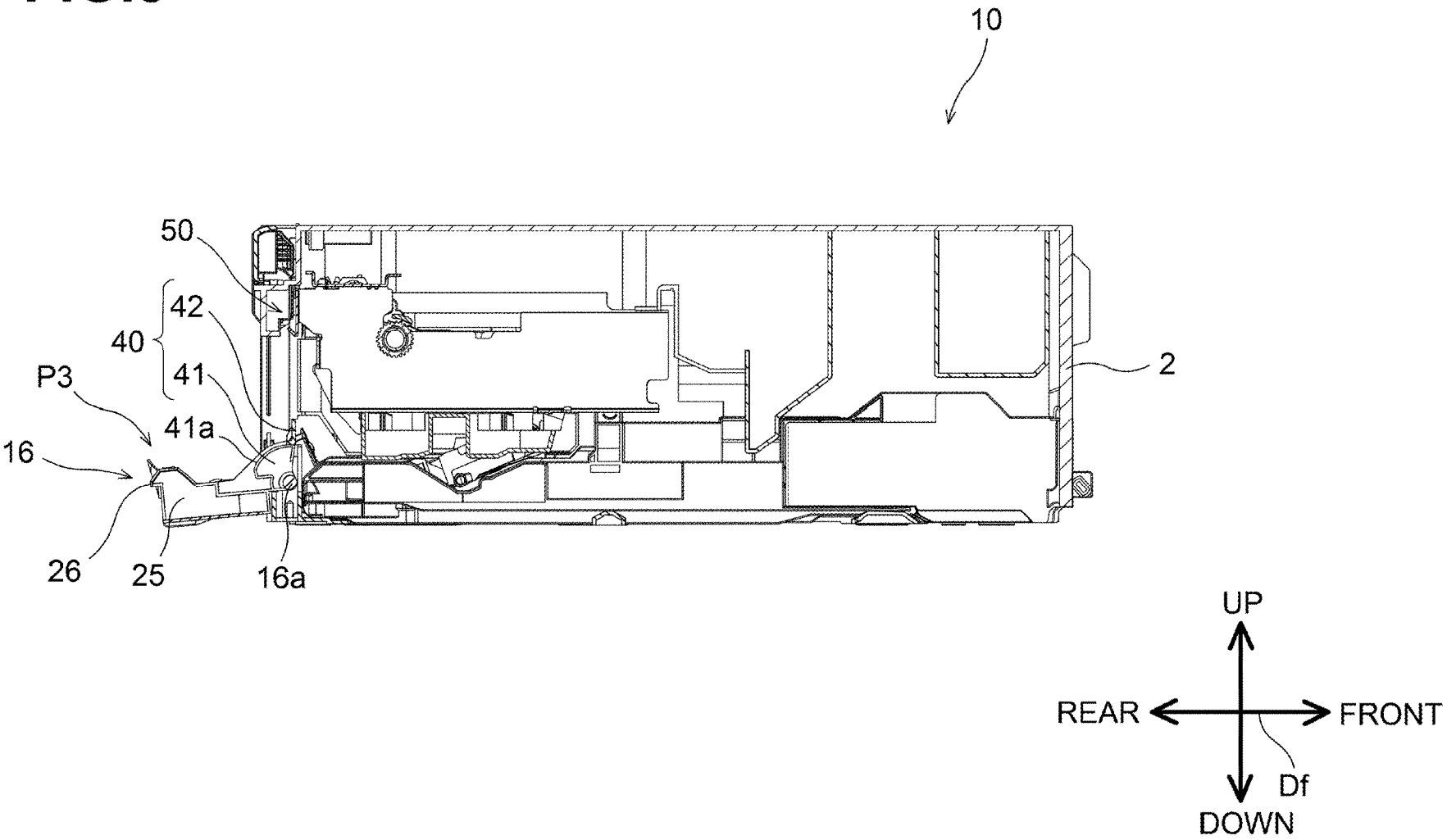
FIG. 8 is a cross-sectional view showing an internal structure of the image recording apparatus when the pivot member shown in FIG. 1 is at a third position (in an open state).
Figure 9:
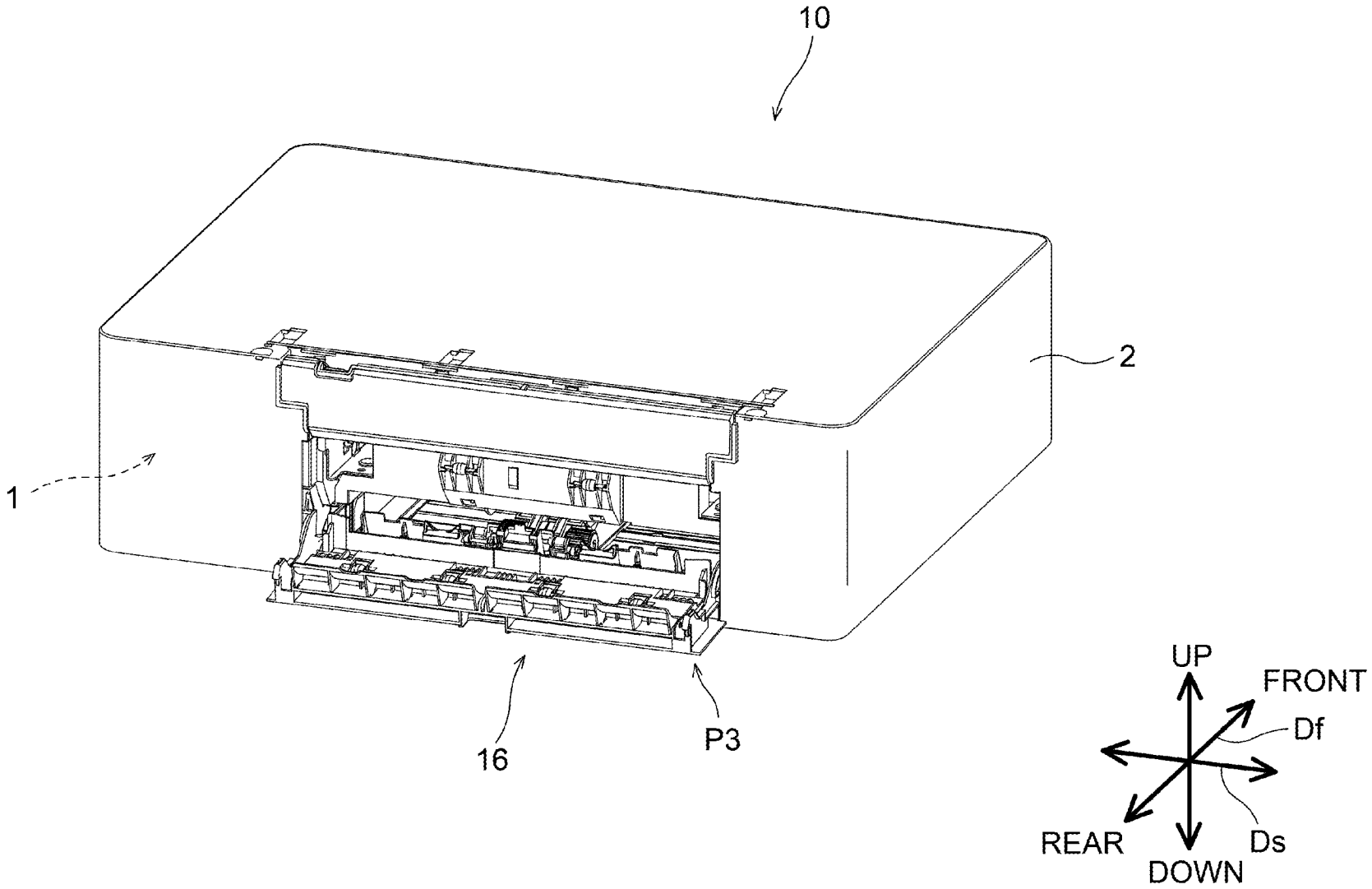
FIG. 9 is a perspective view of the image recording apparatus when the pivot member shown in FIG. 1 is in the open state.

The guide mechanism 40 thus structured guides the pivot member 16 to a lower position than the second position P2 during passing of the guide flap 28 under a lower end of the frame 50 when the pivot member 15 pivots between the second position P2 and the third position P3. Specifically, when the pivot member 16 starts pivoting from the second position P2 toward the third position P3, the contact member 42 contacts the oblique flat surface 41*a*1. The cam 41 pivots while being pushed by the contact member 42 to gradually move down. Thus, the main body 25 of the pivot member 16 pivots while being guided to a position lower than the second position P2 against an increasing urging force of each urging member 36. This structure allows the pivot member 16 to pivot from the second position P2 to the third position P3 (open state) shown in FIGS. 8 and 9 without interference between an upper end 28*b* of the guide flap 20 and the lower end of the frame 50.

In the transport device 1 according to the above-described embodiment, each engagement portion 26 of the pivot member 16 is urged by a corresponding urging member 36 to engage the frame 50. Thus, the frame holds the pivot member 16 at the first position P1. The pivot member 16 is readily maintained in the closed state without the need for separately providing a lock member for holding the pivot member 16 in the closed state. There is no need to make use of elasticity of a pivot member made of resin nor increase a holding force generated by the elasticity to hold the pivot member 16 in the closed state. Accordingly, operability in opening and closing the pivot member 16 may not be traded off by the need for increasing the holding force of the pivot member.

In the above-described embodiment, the main body 25 of the pivot member 16 has the guide surface 25*b* that guides a sheet K upwardly in the transport direction. The guide surface 25*b* receives a force from the sheet K in the same direction as the direction in which each urging member 36 urges the pivot member 16 toward the first position P1. Thus, the pivot member 16 is unlikely to move from the closed state to the open state. The pivot member 16 is maintained with this simple structure in the closed state.

When plural sheets K are fed to the separator 30, the separator 30 separates underlining sheets K from an uppermost sheet K. This may prevent feeding of multiple sheets further downstream of the separator 30.

The pivot member 16 is guided to a position lower than the second position P2 during passing of the guide flap 28 under a lower end of the frame 50 when the pivot member 16 pivots from the second position P2 toward the third position P3. This structure may prevent interference between an upper end 28*b* of the guide flap 28 with a lower end of the frame 50.

In the above-described embodiment, the guide frame 21*a* and the drive shaft 13*a* of the transport roller 13 are supported by the frame 50 which positions the pivot member 16 into the first position P1. The frame 50 thus structured positions the pivot member 16, the transport roller 13, and the ejection head 22, thereby improving the accuracy in transporting a sheet K relative to the ejection head 22. As a result, faulty image recording may be prevented or reduced.

Modifications

While the disclosure has been described in detail with reference to the specific embodiment thereof, this is merely an example, and various changes, arrangements and modifications may be applied therein without departing from the spirit and scope of the disclosure.

Although, in the above-described embodiment, a spring is used as each urging member 36, other urging members, such as an elastic member, may be used. The urging members 36 may not be provided in pair.

Although, in the above-described embodiment, the operative portion 27 is a groove formed by cutting out the thick portion of the main body 25, a projection which projects rearwardly from the main body 25 may be used as the operative portion 27 instead of the groove.

Although, in the above-described embodiment, the guide portion 35 is formed as a groove in a wall inside the housing 2, a groove may be formed, as the guide portion 35, in a plate having a predetermined thickness and supported by a wall of the housing 2.

In the above-described embodiment, a sheet K is fed, along the transport path H, from the holder 11 toward the pivot member 16 and travels past the pivot member 16 toward the front. Any transport path H, whose portion is defined by the pivot member 16, is applicable.

Figure 10:
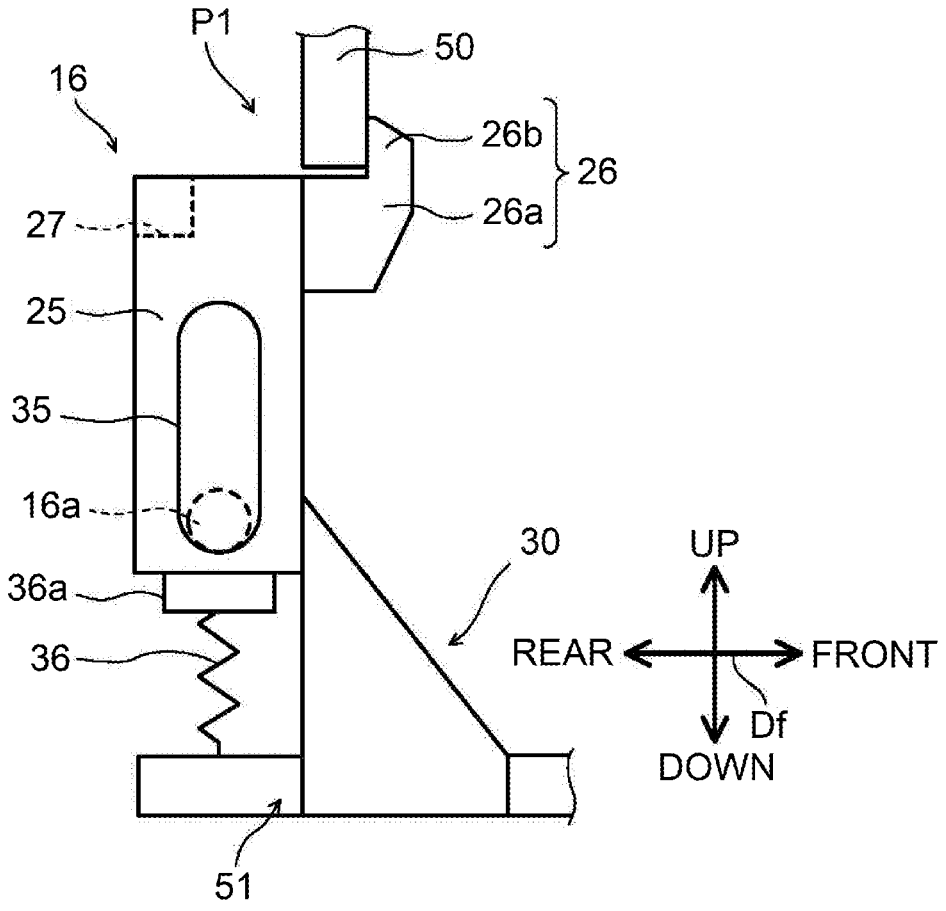
FIG. 10 is a side schematic view of a pivot member of a transport device according to modification of the illustrative embodiment.

In the above-described embodiment, the pivot member 16 includes the pivot shaft 16*a* and the housing 2 includes the guide portion 35. However, as shown in FIG. 10, the housing 2 may include a pivot shaft 16*a* and the pivot member 16 may include a guide portion 35.

What is claimed is:

1. A transport device comprising:

a frame;

a holder configured to hold one or more sheets;

a feed roller configured to feed a sheet from the holder in a transport direction along a transport path;

a cover defining a portion of the transport path, the cover being pivotable between a closed state and an open state, the cover being movable while in the closed state between a first position and a second position lower than the first position, the cover including a pivot shaft about which the cover is pivotable; and an urging member urging the cover in an urging direction from the second position toward the first position, wherein the cover includes;

a main body configured to define the portion of the transport path and guide the sheet in the transport direction;

an engagement portion disposed at the main body, wherein:

the engagement portion is engaged with the frame when the cover is at the first position to restrict pivoting of the cover from the first position to a third position at which the cover is in the open state, and the engagement portion is disengaged from the frame when the cover is at the second position to allow pivoting of the cover from the second position to the third position, wherein the transport device further comprises a guide configured to, in response to the cover pivoting from the second position to the third position, guide the pivot shaft of the cover to a position lower than a position of the pivot shaft when the cover is at the second position.

2. The transport device according to claim 1, further comprising:

an operating portion disposed at the main body and operable in a direction opposite to the urging direction of the urging member to move the cover to the second position from which the cover is pivotable to the third position.

3. The transport device according to claim 2, wherein the urging direction is oriented upwardly from the second position to the first position.

4. The transport device according to claim 2, further comprising a separator disposed along the transport path between the feed roller and the guide surface of the main body of the cover located at the first position, the separator being configured to separate the sheet from other sheets, wherein the cover has a recess which is recessed so as not to interfere with the separator when the cover is at the second position.

5. The transport device according to claim 2, wherein the operative portion is disposed at a center of the main body of the cover in a width direction.

6. The transport device according to claim 1, wherein the main body is movable, as part of the cover, between the first position and the second position, and pivotable, as part of the cover, between the second position and the third position.

7. The transport device according to claim 1, wherein the main body of the cover has a guide surface positioned to guide the sheet in the transport direction in a same direction as the urging direction of the urging member.

8. The transport device according to claim 1, wherein the cover further includes a guide flap defining a portion of the transport path and having an upper end located above a lower end of the frame when the cover is located at the first position.

9. The transport device according to claim 8, wherein the guide includes:

a cam disposed at the cover and having a curved slide surface; and a contact member configured to, during pivoting of the cover, contact the slide surface of the cam.

10. The transport device according to claim 8, wherein the guide is configured to guide the pivot shaft of the cover to the lower position to pass the guide flap under the lower end of the frame as the cover pivots between the second position and the third position.

11. The transport device according to claim 1, further comprising:

a transport roller disposed downstream of the cover in the transport direction and having a drive shaft;

a carriage supporting a recording unit for recording on the sheet; and a guide frame supporting the carriage, wherein the drive shaft and the guide frame are supported by the frame.

12. An image recording apparatus comprising:

a housing;

a print unit within the housing; and a transport device disposed at least in part within the housing, the transport device comprising:

a frame;

a holder configured to hold one or more sheets;

a feed roller configured to feed a sheet from the holder in a transport direction along a transport path;

a cover defining a portion of the transport path, the cover being pivotable about a pivot shaft disposed at one of the cover and the housing between a closed state and an open state in which the portion of the transport path is exposed externally to the housing, the cover being movable while in the closed state between a first position and a second position lower than the first position;

an urging member urging the cover in an urging direction from the second position toward the first position; and a guide portion disposed at the other of the cover and the housing to extend in the urging direction and be engaged with the pivot shaft, the guide portion being configured to guide the cover between the first position and the second position, wherein the cover includes:

a main body configured to define the portion of the transport path and guide the sheet in the transport direction;

an engagement portion disposed at the main body, wherein:

the engagement portion is engaged with the frame when the cover is at the first position to restrict pivoting of the cover from the first position to a third position at which the cover is in the open state, and the engagement portion is disengaged from the frame when the cover is at the second position to allow pivoting of the cover from the second position to the third position;

wherein the transport device further comprises a guide configured to, in response to the cover pivoting from the second position to the third position, guide the pivot shaft of the cover to a position lower than a position of the pivot shaft when the cover is at the second position.

13. The image recording apparatus according to claim 12, wherein the cover is positioned on a rear side of the housing.

14. The image recording apparatus according to claim 13, further comprising:

a manual contact surface disposed at the main body, the manual contact surface being manually operable in a direction opposite to the urging direction of the urging member to move the cover to the second position from which the cover is pivotable to the third position.

15. The image recording apparatus according to claim 14, wherein the manual contact surface is positioned proximate to a top edge of the main body of the cover.

16. A method for moving a cover between a closed state and an open state, the cover is positioned on a rear side of an image recording apparatus and defining a portion of a transport path, the method comprising:

pushing down the cover from a first position in which the cover is prevented from rotating to a second position in which the cover being pivotable about a pivot shaft between the closed state and the open state;

rotating the cover from the second position to a third position in which the portion of the transport path is exposed externally to the image recording apparatus, wherein rotating the cover from the second position to the third position engages a guide to a pivot shaft of the cover to move the pivot shaft to a position lower than a position of the pivot shaft when the cover is at the second position;

rotating the cover from the third position to the second position and the cover moves from the second position to the first position by an urging member urging the cover in an urging direction from the second position toward the first position.

17. A method of operating a cover of an image recording apparatus, the cover being pivotable between an open state and a closed state in which the cover forms at least a portion of a transport path along which a sheet is fed through the image recording apparatus, the method comprising:

moving a main body of the cover downward from a first position to a second position, to disengage an engagement portion of the cover from a frame, by depressing a manual contact surface disposed on the main body, wherein depressing the manual contact surface counteracts an urging force urging the main body toward the first position from the second position, and wherein the first position and the second position both correspond to the closed state, and in the first position the main body is prevented from pivoting to the open state; and pivoting the main body from the second position to a third position corresponding to the open state of the cover, thereby exposing at least a portion of the transport path external to the image recording apparatus and engaging a guide to a pivot shaft of the cover to move the pivot shaft to a position lower than a position of the pivot shaft when the cover is at the second position.

18. The method of claim 17, further comprising:

pivoting the main body from the third position to the second position; and releasing the cover, thereby allowing the urging force to return the cover to the first position.

* * * * *